US011145472B2

(12) United States Patent
Zhang et al.

(10) Patent No.: US 11,145,472 B2
(45) Date of Patent: Oct. 12, 2021

(54) ELECTRICAL CONTACT SYSTEM

(71) Applicant: Tyco Electronics (Shenzhen) Co. Ltd, Shenzhen (CN)

(72) Inventors: Xiaoning Zhang, Shenzhen (CN); Teng Zou, Shenzhen (CN)

(73) Assignee: Tyco Electronics (Shenzhen) Co. Ltd, Shenzhen (CN)

( * ) Notice: Subject to any disclaimer, the term of this patent is extended or adjusted under 35 U.S.C. 154(b) by 0 days.

(21) Appl. No.: 16/698,495

(22) Filed: Nov. 27, 2019

(65) Prior Publication Data

US 2020/0098531 A1 Mar. 26, 2020

Related U.S. Application Data

(63) Continuation of application No. PCT/EP2018/064350, filed on May 31, 2018.

(30) Foreign Application Priority Data

Jun. 1, 2017 (CN) ..... 201710403473.X

(51) Int. Cl.
*H01H 9/32* (2006.01)
*H01H 1/20* (2006.01)

(52) U.S. Cl.
CPC ..... *H01H 9/32* (2013.01); *H01H 1/20* (2013.01)

(58) Field of Classification Search
CPC ..... H01H 9/32; H01H 1/2058; H01H 1/20; H01H 33/06; H01H 33/53; H01H 73/045;
(Continued)

(56) References Cited

U.S. PATENT DOCUMENTS 3,564,176 A * 2/1971 Fechant ..... H01H 1/20 218/149
4,596,911 A * 6/1986 Guery ..... H01H 33/06 218/117

(Continued)

FOREIGN PATENT DOCUMENTS

CN 201689799 U 12/2010
FR 2982995 A1 5/2013

OTHER PUBLICATIONS

Translation FR2982995 (Original document published May 24, 2013) (Year: 2013).*

(Continued)

*Primary Examiner* — William A Bolton
(74) *Attorney, Agent, or Firm* — Barley Snyder

(57) ABSTRACT

An electrical contact system includes a static contact, a movable contact movable between a switch-on position with the movable contact in electrical contact with the static contact and a switch-off position with the movable contact separated from the static contact, and an arc extinguishing device including an arc extinguishing member and a driving mechanism. When the movable contact is moved to the switch-on position, the arc extinguishing member is moved beyond a contact area between the movable contact and the static contact and the movable contact is allowed to be in electrical contact with the static contact. When the movable contact is moved to the switch-off position, the arc extinguishing member is moved between the movable contact and the static contact and the movable contact is electrically isolated from the static contact.

17 Claims, 3 Drawing Sheets

(58) Field of Classification Search
CPC ..... H01H 73/18; H01H 50/546; H01H 9/102; H01H 31/24; H02B 11/24
USPC ..... 218/117, 110, 105, 115; 200/10, 50.22
See application file for complete search history.

(56) References Cited

U.S. PATENT DOCUMENTS 4,647,741 A 3/1987 Belbel et al.
4,659,887 A * 4/1987 Belbel ..... H01H 9/32 218/117
4,801,772 A * 1/1989 Bratkowski ..... H01H 9/32 218/117
4,849,591 A * 7/1989 Comtois ..... H01H 3/60 218/117
4,880,948 A * 11/1989 Kandatsu ..... H01H 9/32 218/117
6,084,193 A * 7/2000 Pelion ..... H01H 9/32 218/117
2002/0157933 A1* 10/2002 Leve ..... H01H 9/32 200/334
2012/0152903 A1* 6/2012 Vigouroux ..... H01H 71/526 218/117
2014/0048513 A1* 2/2014 Sato ..... H01H 33/06 218/117

OTHER PUBLICATIONS

Notification, and International Search Report and Written Opinion of the International Searching Authority, PCT/EP2018/064350, dated Aug. 17, 2018, 14 pages.
Abstract of FR 2982995 A1, dated May 24, 2013, 1 page.
Abstract of CN 201689799 U, dated Dec. 29, 2010, 1 page.

* cited by examiner

ELECTRICAL CONTACT SYSTEM

CROSS-REFERENCE TO RELATED APPLICATIONS

This application is a continuation of PCT International Application No. PCT/EP2018/064350, filed on May 31, 2018, which claims priority under 35 U.S.C. § 119 to Chinese Patent Application No. 201710403473.X, filed on Jun. 1, 2017.

FIELD OF THE INVENTION

The present invention relates to an electrical contact system and, more particularly, to an electrical contact system having an arc extinguishing device.

BACKGROUND

An electrical contact in an electric switch device and the control appliance may discharge and generate an electric arc during switching on to off or off to on. The generation of the electric arc may delay connection and disconnection of an electric circuit and even burn the electrical contacts, resulting in the melting and welding of the electrical contacts. In a severe case, it may cause ignition and explosion of the electric switch device having the electrical contacts. Therefore, an arc extinguishing device needs to be designed to achieve an efficient and reliable arc extinguishing effect.

An electric switch device, such as a high-voltage direct current relay, usually uses a sealed inflatable magnetic field to lengthen a metal phase electric arc laterally, so that the electric arc may be cooled and deionized rapidly in an arc extinguishing medium. Such a method has a good arc extinguishing effect, but the manufacturing process thereof is complex, which results in a high cost.

Another kind of arc extinguishing device is configured to blow the electric arc to a metal grid plate by magnetic blowing, and the electric arc is cut into several segments of short electric arcs by the metal grid plate, which enhances an initial dielectric strength of a gap between the segments of short electric arcs. In addition, the metal grid plate improves the cooling effect and the surface deionization effect. However, the arc extinguishing speed of this arc extinguishing device is not ideal.

SUMMARY

An electrical contact system includes a static contact, a movable contact movable between a switch-on position in which the movable contact is in electrical contact with the static contact and a switch-off position in which the movable contact is separated from the static contact, and an arc extinguishing device including an arc extinguishing member and a driving mechanism configured to drive the arc extinguishing member to move. When the movable contact is moved to the switch-on position, the arc extinguishing member is moved beyond a contact area between the movable contact and the static contact and the movable contact is allowed to be in electrical contact with the static contact. When the movable contact is moved to the switch-off position, the arc extinguishing member is moved into the contact area between the movable contact and the static contact and the movable contact is electrically isolated from the static contact.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
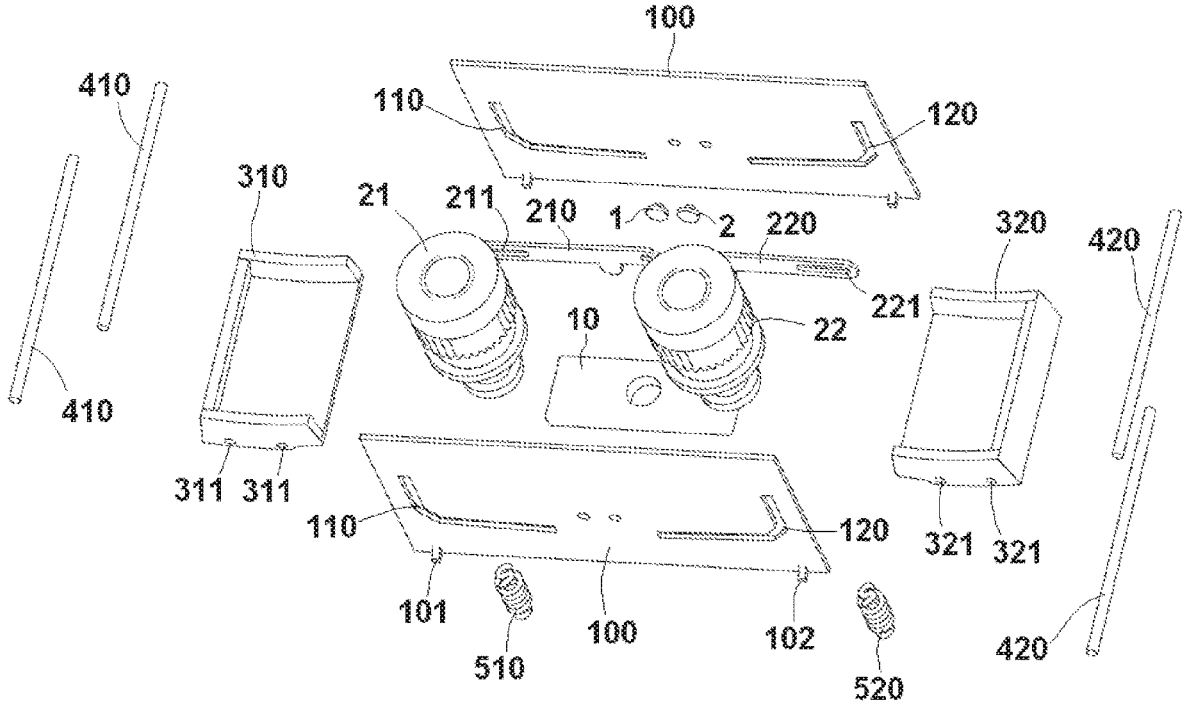
FIG. 1 is an exploded perspective view of an electrical contact system according to an embodiment.

Exemplary embodiments of the present disclosure will be described hereinafter in detail with reference to the attached drawings, wherein like reference numerals refer to like elements. The present disclosure may, however, be embodied in many different forms and should not be construed as being limited to the embodiment set forth herein; rather, these embodiments are provided so that the present disclosure will convey the concept of the disclosure to those skilled in the art.

In addition, in the following detailed description, for purpose of explanation, numerous specific details are set forth in order to provide a thorough understanding of the disclosed embodiments. However, it is apparent that one or more embodiments may also be implemented without these specific details. In other instances, well-known means and devices are schematically shown in the drawings to simplify the drawings.

Figure 2:
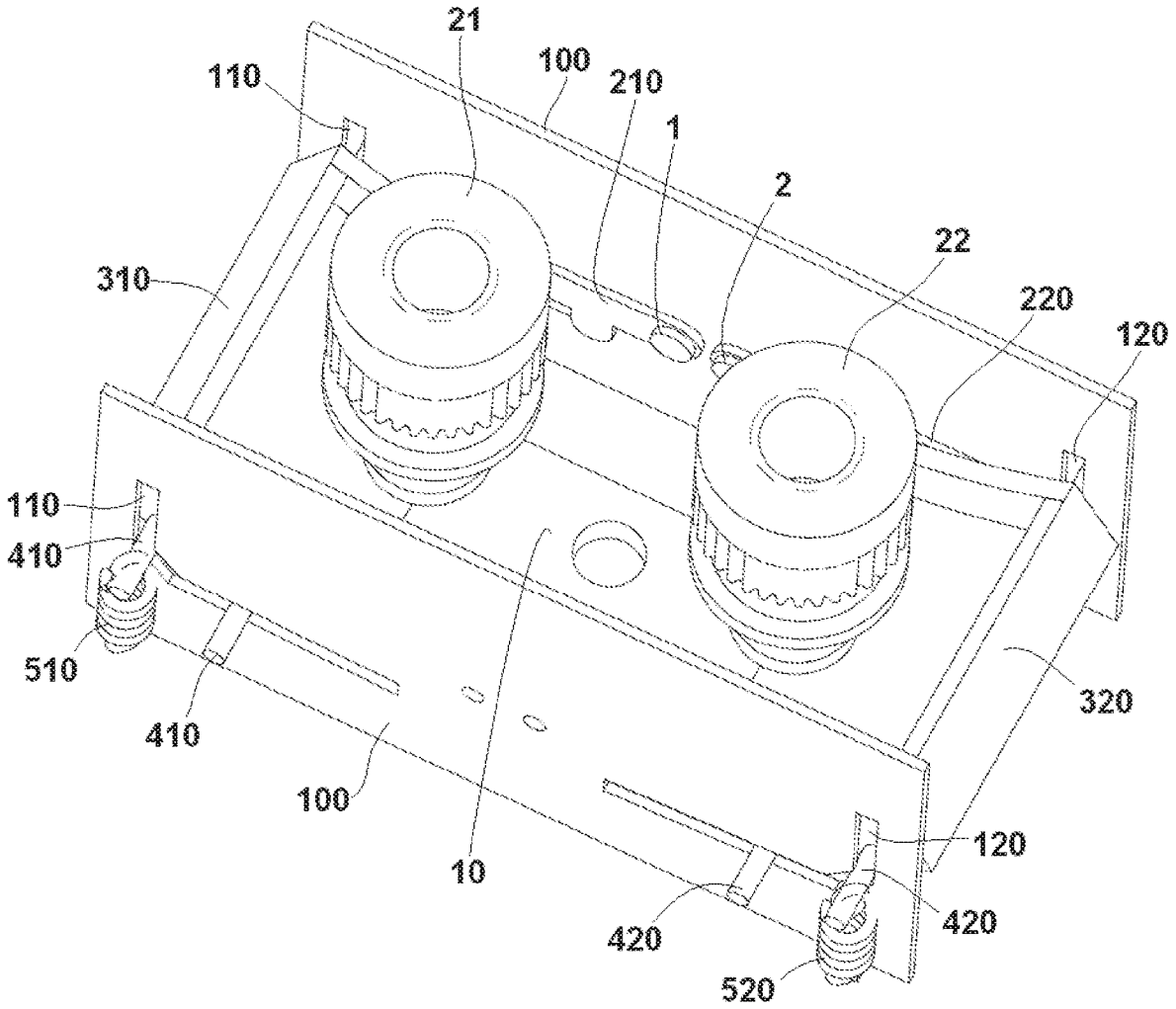
FIG. 2 is a perspective view of the electrical contact system.
Figure 3:
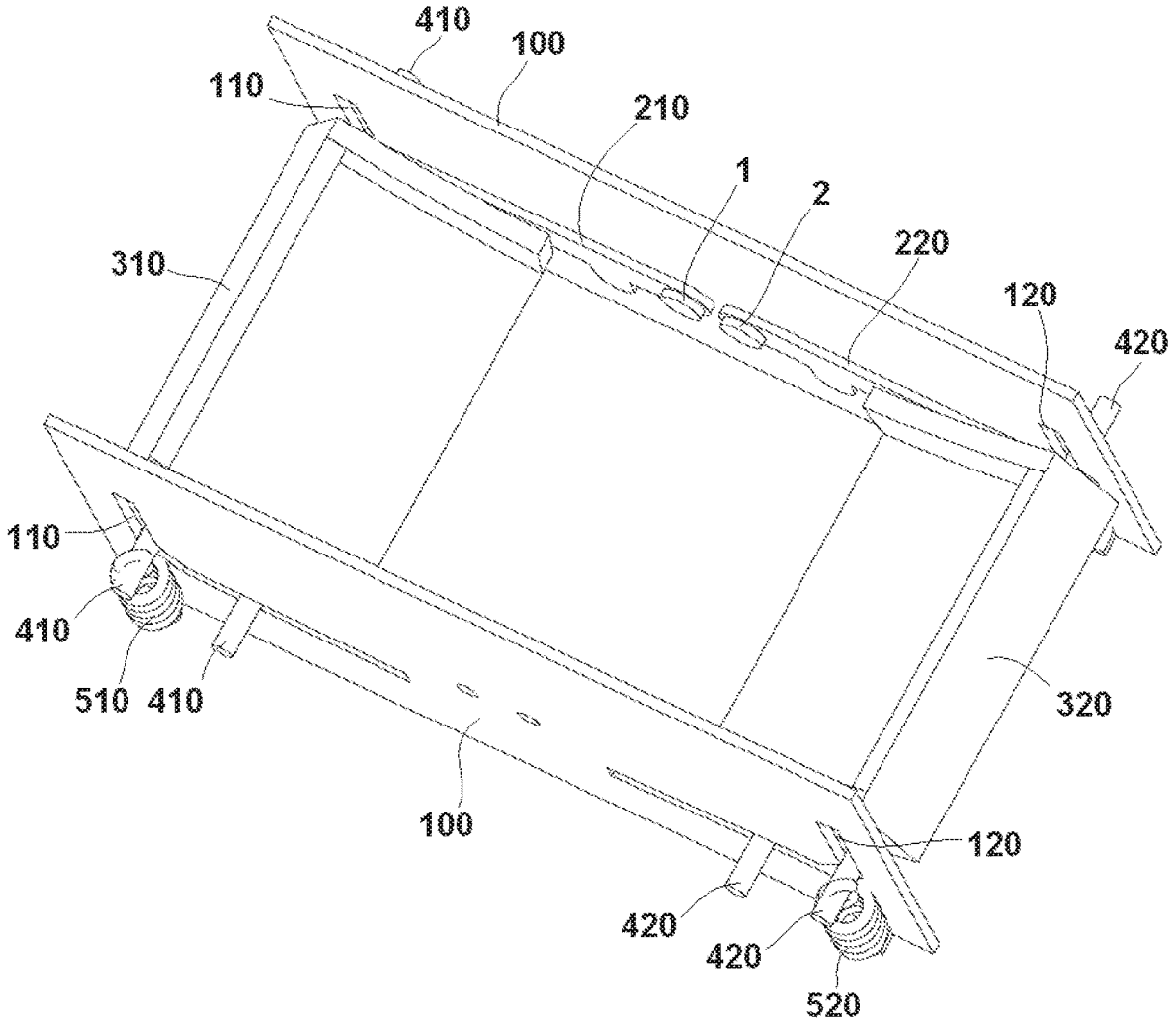
FIG. 3 is a perspective view of the electrical contact system without a movable contact and a static contact.

An electrical contact system according to an embodiment, as shown in FIGS. 1-3, comprises a movable contact 10, a static contact 21, 22 and an arc extinguishing device. The movable contact 10 is driven to be movable between a switch-on position where the movable contact 10 is in electrical contact with the static contact 21, 22 and a switch-off position where the movable contact 10 is separated from the static contact 21, 22. The arc extinguishing device includes arc extinguishing member 310, 320 and a driving mechanism configured to drive the arc extinguishing member 310, 320 to move between an arc extinguishing position and a non-extinguishing position.

When the movable contact 10, shown in FIGS. 1 and 2, is driven to move to the switch-on position, the arc extinguishing member 310, 320 is driven to move to the non-extinguishing position where the arc extinguishing member 310, 320 is located beyond the contact area between the movable contact 10 and the static contact 21, 22 so as to allow the movable contact 10 to be in electrical contact with the static contact 21, 22. When the movable contact 10 is driven to move to the switch-off position, the arc extinguishing member 310, 320 is driven to move to the arc extinguishing position where the arc extinguishing member 310, 320 is located in the contact area between movable contact 10 and the static contact 21, 22. Then, the movable contact 10 is electrically isolated from the static contact 21, 22 by the arc extinguishing member 310, 320 so as to cut off the electric arc between the movable contact 10 and the static contact 21, 22.

As shown in FIGS. 1 and 2, the static contact 21, 22 includes a first static contact 21 and a second static contact 22. The movable contact 10 is configured to be in electrical contact with the first static contact 21 and the second static contact 22 simultaneously. In the shown embodiment, the electrical contact system is constructed as a dual contact electrical contact system.

The arc extinguishing member 310, 320, as shown in FIGS. 1-3, includes a first arc extinguishing member 310 and a second arc extinguishing member 320. The driving mechanism is configured to simultaneously drive the first arc extinguishing member 310 and the second arc extinguishing member 320 to be moved between the arc extinguishing position and the non-extinguishing position.

When the movable contact 10 is moved to the switch-on position, the first arc extinguishing member 310 is driven to move to the non-extinguishing position where the first arc extinguishing member 310 is located beyond the contact area between the movable contact 10 and the first static contact 21, such that the movable contact 10 is allowed to be in electrical contact with the first static contact 21. Likewise, when the movable contact 10 is moved to the switch-on position, the second arc extinguishing member 320 is driven to move to the non-extinguishing position where the second arc extinguishing member 320 are located beyond the contact area between the movable contact 10 and the second static contact 22, such that the movable contact 10 is allowed to be in electrical contact with the second static contact 22.

When the movable contact 10 is rotated to the switch-off position, the first arc extinguishing member 310 is driven to move to the arc extinguishing position where the first arc extinguishing member 310 are located in the contact area between the movable contact 10 and the first static contact 21, such that the movable contact 10 is electrically isolated from the first static contact 21 to cut off the electric arc between the movable contact 10 and the first static contact 21. Likewise, when the movable contact 10 is rotated to the switch-off position, the second arc extinguishing member 320 is moved to the arc extinguishing position where the second arc extinguishing member 320 is located in the contact area between the movable contact 10 and the second static contact 22, such that the movable contact 10 is electrically isolated from the second static contact 22 to cut off the electric arc between the movable contact 10 and the second static contact 22.

The driving mechanism, as shown in FIGS. 1-3, includes a pair of supporting plates 100, a pair of first pushing rods 210, a pair of second pushing rods 220, a pair of first linkage shafts 410 and a pair of second linkage shafts 420. A first sliding slot 110 and a second sliding slot 120 are formed in each supporting plate 100. Each of the pair of first pushing rods 210 is rotatably mounted at a first end thereof, a right end in FIG. 1, to a corresponding supporting plate 100, and is formed with a third sliding slot 211 at a second end thereof, a left end in FIG. 1. Each of the pair of second pushing rods 220 is rotatably mounted at a first end thereof, a left end in FIG. 1, to a corresponding supporting plate 100 and is formed with a fourth sliding slot 221 at a second end, a right end in FIG. 1. The pair of first linkage shafts 410 are respectively inserted into two passageways 311 in the first arc extinguishing member 310. The pair of second linkage shafts 420 are respectively inserted into two passageways 321 in the second arc extinguishing member 320.

As shown in FIGS. 1-3, opposite ends of each of the pair of first linkage shafts 410 are respectively received in the first sliding slots 110 of the pair of supporting plates 100, and opposite ends of one of the pair of first linkage shafts 410 located on an outer side are respectively further received in the third sliding slots 211 of the pair of first pushing rods 210. Opposite ends of each of the pair of second linkage shafts 420 are respectively received in the second sliding slots 120 of the pair of supporting plates 100, and opposite ends of one of the pair of second linkage shafts 420 located on an outer side are respectively further received in the fourth sliding slots 221 of the pair of second pushing rods 220.

When the pair of first pushing rods 210 are rotated about the first ends thereof, a right end in FIG. 1, under the action of an external pushing force, for example a magnetic thrust force, the pair of first pushing rods 210 drive the first arc extinguishing member 310 to move from the arc extinguishing position where the first arc extinguishing member 310 is located in the contact area between the movable contact 10 and the first static contact 21 to the non-extinguishing position where the first arc extinguishing member 310 is located beyond contact area between the movable contact 10 and the first static contact 21. Likewise, when the pair of second pushing rods 220 are rotated about the first ends thereof, a left end in FIG. 1, under the action of an external pushing force, the pair of second pushing rods 220 drive the second arc extinguishing member 320 to move from the arc extinguishing position where the second arc extinguishing member 320 is located in the contact area between the movable contact 10 and the second static contact 22 to a non-extinguishing position where the second arc extinguishing member 320 is located beyond the contact area between the movable contact 10 and the second static contact 22.

The driving mechanism, as shown in FIGS. 1-3, further includes a pair of first return springs 510 and a pair of second return springs 520. Each of the pair of first return springs 510 is connected at a first end thereof, a lower end in FIG. 1, to a corresponding supporting plate 100 and is connected at a second end thereof, an upper end in FIG. 1, to an end of the one of the pair of first linkage shafts 410 located on outer side. When the pushing force applied to the pair of first pushing rods 210 disappears, the first arc extinguishing member 310 is automatically moved from the non-extinguishing position to the arc extinguishing position under the action of the elastic restoring force of the pair of first return springs 510. Likewise, Each of the pair of second return springs 520 is connected at a first end thereof, a lower end in FIG. 1, to a corresponding supporting plates 100 and is connected at a second end thereof, an upper end in FIG. 1, to an end of the one of the pair of second linkage shafts 420 located on outer side. When the pushing force applied to the pair of second pushing rods 220 disappears, the second arc extinguishing member 320 is automatically moved from the non-extinguishing position to the arc extinguishing position under the action of the elastic restoring force of the pair of second return springs 520.

As shown in FIGS. 1-3, the first sliding slots 110 and the second sliding slots 120 both extend along arcuate paths, respectively. The pair of first linkage shafts 410 are slidable along the arcuate path defined by the first sliding slots 110, and the pair of second linkage shafts 420 are slidable along the arcuate path defined by the second sliding slots 120.

As shown in FIG. 1, the third sliding slots 211 in the pair of first pushing rods 210 and the fourth sliding slots 221 in the pair of second pushing rods 220 both extend straightly. The one of the pair of first linkage shafts 410 located on the outer side is slidable along the third sliding slots 211 in the pair of first pushing rods 210, and the one of the pair of second linkage shafts 420 located on the outer side is slidable along the fourth sliding slots 221 in the pair of second pushing rods 220.

As shown in FIGS. 1-3, the pair of first pushing rods 210 are pivotally connected at the first ends thereof to the pair of supporting plates 100 by a pair of first articulating shafts 1, respectively. The pair of second pushing rods 220 are pivotally connected at the first ends thereof to the pair of supporting plates 100 by a pair of second articulating shafts 2.

In the foregoing exemplary embodiments, the arc extinguishing member 310, 320 may be driven by the pushing rods 210, 220 to be quickly moved to the arc extinguishing position where the arc extinguishing members 310, 320 are located in the contact area between the movable contact 10 and the static contact 21, 22, so that the electric arc between the movable contact 10 and the static contact 21, 22 may be quickly cut off to achieve an efficient and reliable arc extinguishing effect.

In the foregoing embodiments, the mechanism of the overall electrical contact system is very simple, which facilitates manufacturing and assembling and is high reliable. Moreover, the size of the overall electrical contact system may be miniaturized, the overall electrical contact system requires less drive energy, has low energy consumption, and may realize reliable connection and disconnection of an electric circuit having the electrical contact system.

Those skilled in the art can understand that the above-described embodiments are all exemplary. The structures described in the various embodiments can be freely combined without a conflict in structure or principle.

Although the present disclosure has been described with reference to the accompanying drawings, the embodiments disclosed in the accompanying drawings are intended to illustrate the embodiments of the present disclosure exemplarily, and cannot be construed as a limitation of the present disclosure.

Although some embodiments according to the present general inventive concept have been shown and described, those of ordinary skill in the art will understand that modifications may be made to these embodiments without departing from the principle and spirit of the present general inventive concept. The scope of the disclosure is defined by the claims and their equivalents.

What is claimed is:

1. An electrical contact system comprising:

a first static contact and a second static contact;

a movable contact movable between a switch-on position where the movable contact is in electrical contact with the first static contact and the second static contact simultaneously and a switch-off position where the movable contact is separated from the first and second static contacts; and an arc extinguishing device comprising:

a first arc extinguishing member and a second arc extinguishing member; and a driving mechanism configured to simultaneously drive the first and second arc extinguishing members to move, the driving mechanism comprising:

a pair of supporting plates each of which is formed with a first sliding slot and a second sliding slot;

a pair of first pushing rods each of which is rotatably mounted at one end thereof to a corresponding supporting plate and is formed with a third sliding slot at the other end thereof;

a pair of second pushing rods each of which is rotatably mounted at one end thereof to a corresponding supporting plate, and is formed with a fourth sliding slot at the other end thereof;

a pair of first linkage shafts which are respectively inserted into two through holes in the first arc extinguishing member; and a pair of second linkage shafts which are respectively inserted into two through holes in the second arc extinguishing member:

wherein two ends of each of the pair of first linkage shafts are respectively received in the first sliding slots of the pair of supporting plates, and two ends of one of the pair of first linkage shafts located on outer side are respectively received in the third sliding slots of the pair of first pushing rods; and wherein two ends of each of the pair of second linkage shafts are respectively received in the second sliding slots of the pair of supporting plates, and two ends of one of the pair of second linkage shafts located on outer side are respectively received in the fourth sliding slots of the pair of second pushing rods, wherein when the movable contact is moved to the switch-on position, the first and second arc extinguishing members are moved beyond a contact area between the movable contact and the first and second static contacts, such that the movable contact is allowed to be in electrical contact with the first and second static contacts; and wherein when the movable contact is moved to the switch-off position, the first and second arc extinguishing members are moved to cut off electric arcs between the movable contact and the first and second static contacts.

2. The electrical contact system of claim 1, wherein when the pair of first pushing rods are rotated about the ends thereof, the pair of first pushing rods drive the first arc extinguishing member to move from an arc extinguishing position to a non-extinguishing position; and wherein when the pair of second pushing rods are rotated about the ends thereof, the pair of second pushing rods drive the second arc extinguishing member to move from an arc extinguishing position to a non-extinguishing position.

3. The electrical contact system of claim 2, wherein the driving mechanism further comprises:

a pair of first return springs each of which is connected at one end thereof to the corresponding supporting plates and is connected at the other end thereof to an end of the one of the pair of first linkage shafts located on outer side so as to move the first arc extinguishing member from the non-extinguishing position to the arc extinguishing position; and a pair of second return springs each of which is connected at one end thereof to the corresponding supporting plates and is connected at the other end thereof to an end of the one of the pair of second linkage shafts located on outer side so as to move the second arc extinguishing member from the non-extinguishing position to the arc extinguishing position.

4. The electrical contact system of claim 1, wherein the first sliding slots and the second sliding slots both extend along arcuate paths, respectively, and wherein the pair of first linkage shafts are slidable along the arcuate path defined by the first sliding slots, and the pair of second linkage shafts are slidable along the arcuate path defined by the second sliding slots.

5. The electrical contact system of claim 4, wherein the third sliding slot and the fourth sliding slot both extend straightly, and wherein the one of the pair of first linkage shafts located on the outer side is slidable along the third sliding slot, and the one of the pair of second linkage shafts located on the outer side is slidable along the fourth sliding slot.

6. The electrical contact system of claim 1, wherein the pair of first pushing rods are respectively pivotally connected at the ends thereof to the pair of supporting plates via first articulating shafts; and wherein the pair of second pushing rods are respectively pivotally connected at the end thereof to the pair of supporting plates via second articulating shafts.

7. An electrical contact system comprising:

a first static contact;

a second static contact;

a movable contact movable between a switch-on position where the movable contact is in electrical contact with the first and second static contacts and a switch-off position where the movable contact is separated from the first and second static contacts; and an arc extinguishing device comprising:

a first arc extinguishing member;

a second arc extinguishing member; and a driving mechanism configured to simultaneously drive the first and second arc extinguishing members to move to cut off electric arcs between the movable contact and the first and second static contacts, and including:

a pair of supporting plates each of which is formed with a first sliding slot and a second sliding slot;

a pair of first pushing rods each of which is rotatably mounted at one end thereof to a corresponding supporting plate and is formed with a third sliding slot at the other end thereof; and a pair of second pushing rods each of which is rotatably mounted at one end thereof to a corresponding supporting plate, and is formed with a fourth sliding slot at the other end thereof.

8. The electrical contact system of claim 7, wherein the driving mechanism further includes:

a pair of first linkage shafts which are respectively inserted into two through holes in the first arc extinguishing member; and a pair of second linkage shafts which are respectively inserted into two through holes in the second arc extinguishing member:

wherein two ends of each of the pair of first linkage shafts are respectively received in the first sliding slots of the pair of supporting plates, and two ends of one of the pair of first linkage shafts located on outer side are respectively received in the third sliding slots of the pair of first pushing rods; and wherein two ends of each of the pair of second linkage shafts are respectively received in the second sliding slots of the pair of supporting plates, and two ends of one of the pair of second linkage shafts located on outer side are respectively received in the fourth sliding slots of the pair of second pushing rods.

9. The electrical contact system of claim 8, wherein when the pair of first pushing rods are rotated about the ends thereof, the pair of first pushing rods drive the first arc extinguishing member to move from an arc extinguishing position to a non-extinguishing position; and wherein when the pair of second pushing rods are rotated about the ends thereof, the pair of second pushing rods drive the second arc extinguishing member to move from an arc extinguishing position to a non-extinguishing position.

10. The electrical contact system of claim 9, wherein the driving mechanism further comprises:

a pair of first return springs each of which is connected at one end thereof to the corresponding supporting plates and is connected at the other end thereof to an end of the one of the pair of first linkage shafts located on outer side so as to move the first arc extinguishing member from the non-extinguishing position to the arc extinguishing position; and a pair of second return springs each of which is connected at one end thereof to the corresponding supporting plates and is connected at the other end thereof to an end of the one of the pair of second linkage shafts located on outer side so as to move the second arc extinguishing member from the non-extinguishing position to the arc extinguishing position.

11. The electrical contact system of claim 8, wherein the first sliding slots and the second sliding slots both extend along arcuate paths, respectively, and wherein the pair of first linkage shafts are slidable along the arcuate path defined by the first sliding slots, and the pair of second linkage shafts are slidable along the arcuate path defined by the second sliding slots.

12. The electrical contact system of claim 11, wherein the third sliding slot and the fourth sliding slot both extend straightly, and wherein the one of the pair of first linkage shafts located on the outer side is slidable along the third sliding slot, and the one of the pair of second linkage shafts located on the outer side is slidable along the fourth sliding slot.

13. An electrical contact system comprising:

a static contact;

a movable contact movable between a switch-on position where the movable contact is in electrical contact with the static contact and a switch-off position where the movable contact is separated from the static contact; and an arc extinguishing device comprising:

an arc extinguishing member; and a driving mechanism configured to drive the arc extinguishing member to move to prevent an electric arc between the movable contact and the static contact, the driving mechanism comprising:

at least one supporting plate defining a first sliding slot;

at least one first linkage shaft connected to the arc extinguishing member and received within the first sliding slot; and a return spring operatively connected at one end to the at least one supporting plate and connected at the other end thereof to an end of the at least one linkage shaft for moving the arc extinguishing member along the first sliding slot into an arc extinguishing position under an elastic restoring force of the return spring.

14. The electrical contact system of claim 13, wherein the at least one supporting plate comprises a pair of supporting plates each of which is formed with one of the first sliding slots, and the at least one first linkage shaft comprises a pair of first linkage shafts which are respectively inserted into two through holes in the arc extinguishing member, the driving mechanism further including a pair of first pushing rods each of which is rotatably mounted at one end thereof to a corresponding supporting plate and is formed with a second sliding slot at the other end thereof, wherein two ends of each of the pair of first linkage shafts are respectively received in the first sliding slots of the pair of supporting plates, and two ends of one of the pair of first linkage shafts located on outer side are respectively received in the second sliding slots of the pair of first pushing rods.

15. The electrical contact system of claim 14, wherein the return spring comprises a pair of return springs each of which is connected at one end thereof to a corresponding supporting plate and is connected at the other end thereof to an end of the one of the pair of first linkage shafts located on outer side so as to move the first arc extinguishing member from a non-extinguishing position to the arc extinguishing position.

16. The electrical contact system of claim 14, wherein the second sliding slot extends straightly, and wherein the one of the pair of first linkage shafts located on the outer side is slidable along the second sliding slot.

17. The electrical contact system of claim 13, wherein the first sliding slot extends along an arcuate path, and wherein the first linkage shaft is slidable along the arcuate path defined by the first sliding slot.

* * * * *